US005194031A

United States Patent [19]

Sahler

[11] Patent Number: 5,194,031

[45] Date of Patent: Mar. 16, 1993

[54] TOY GEAR ASSEMBLY

[75] Inventor: John T. Sahler, Riverside, R.I.

[73] Assignee: Playskool, Inc., Pawtucket, R.I.

[21] Appl. No.: 666,199

[22] Filed: Mar. 7, 1991

[51] Int. Cl.[5] ..... A63H 33/08

[52] U.S. Cl. ..... 446/103; 74/439; 74/421 R; 74/416; 74/448

[58] Field of Search ..... 446/103, 118, 236; 74/439, 421 R, 416, 325, 447, 448; 434/401; 273/276, 281

[56] References Cited

U.S. PATENT DOCUMENTS

| | | | |
|---|---|---|---|
| 2,095,046 | 10/1937 | Wilner | 273/153 |
| 2,477,441 | 6/1949 | Cole | 434/401 |
| 2,545,131 | 3/1951 | Ayres . | |
| 2,692,443 | 10/1954 | Milligan | 434/401 |
| 3,172,666 | 3/1955 | Ryan | 273/243 |
| 3,193,293 | 7/1965 | Schaper | 273/135 |
| 3,589,060 | 6/1971 | Genin | 446/246 |
| 3,608,233 | 9/1971 | Aoki . | |
| 3,881,274 | 5/1975 | Kanda | 446/103 |
| 3,965,610 | 6/1976 | Den Ouden . | |
| 4,507,095 | 3/1985 | Lin | 446/118 |

FOREIGN PATENT DOCUMENTS

| | | | |
|---|---|---|---|
| 52-26938 | 2/1977 | Japan | 446/103 |

*Primary Examiner*—Mickey Yu

*Attorney, Agent, or Firm*—Salter, Michaelson & Benson

[57] ABSTRACT

A toy gear assembly includes a base, a ring gear assembly, a drive gear, a tripod-like support frame assembly and a plurality of secondary gears. The ring gear assembly includes a rotatable gear ring portion and the ring gear assembly and the drive gear are securable on the base so that the drive gear is received in the interior of the ring gear assembly for rotating the gear ring portion thereof. The support frame assembly is also releasably securable on the base and the secondary gears are receivable on the base and on the support frame assembly for forming various different gear train combinations thereon.

14 Claims, 3 Drawing Sheets

TOY GEAR ASSEMBLY

BACKGROUND AND SUMMARY OF THE INVENTION

The instant invention relates to educational toys and more particularly to a toy gear assembly which is operative with a variety of different amusing and interesting gear motions.

It has generally been found that gear assemblies of a general type comprising a base and a plurality of gears which are adapted to be assembled in various different positions on the base can be effectively utilized for teaching children the interrelationships between the gears of various types of gear trains. It has been further found that gear assemblies of this type can provide a significant degrees of amusement for children. For example, the gear assemblies disclosed in the Wilner U.S. Pat. No. 2,095,046; Cole U.S. Pat. No. 2,477,441; Ayres U.S. Pat. No. 2,545,131; Milligan U.S. Pat. No. 2,692,443; Ryan U.S. Pat. No. 3,172,666; Schaper U.S. Pat. No. 3,193,293; Aoki U.S. Pat. No. 3,608,233; Kanda U.S. Pat. No. 3,881,274; Den Ouden U.S. Pat. No. 3,965,610; and Lin U.S. Pat. No. 4,507,095, which represent the closest prior art to the subject invention of which the applicant is aware, have been found to be effective and amusing educational apparatus. However, the toy gear assemblies disclosed in these references fail to suggest the novel gear structures which are included in the gear assembly of the instant invention, and hence they are believe to be of only general interest with respect thereto.

The toy gear assembly of the instant invention is adapted to provide a variety of new, educational and amusing gear combinations which could not be assembled with the heretofore available gear assemblies. Specifically, the toy gear assembly of the instant invention comprises a base which is adapted to be received on a supporting surface, a ring gear assembly which is releasably receivable on the base, and a support frame assembly which is also releasably receivable on the base. The base preferably has a plurality of upwardly opening receiving sockets therein and the ring gear assembly and the support frame assembly preferably have downwardly extending plugs thereon which are releasably receivable in the sockets in the base. The ring gear assembly includes a mounting ring of ring-like configuration which is releasably securable on the base and a gear ring of ring-like configuration which is received and secured in co-axial relation on the mounting ring so that the gear ring is axially rotatable relative to the mounting ring. The gear ring preferably has inwardly and outwardly facing annular gear ring surfaces thereon, and both of the annular gear ring surfaces on the gear ring preferably have gear teeth thereon. The ring gear is adapted so that it can be utilized in combination with a drive gear which is releasably secured on the base in the interior of the ring gear so that gear teeth on the drive gear intermesh with the gear teeth on the inwardly facing annular gear ring surface of the ring gear. The drive gear preferably has a handle element thereon which is manually rotatable to effect rotation of the ring gear. Further, the ring gear is preferably constructed so that one of either the mounting ring or the gear ring has a plurality of bumps thereon and so that the other one of either the mounting ring or the gear ring has a support ridge of ring-like configuration thereon which rides on the ends of the bumps for rotatably supporting the gear ring on the mounting ring. The support frame comprises at least two frame legs and means joining the frame legs in angular relation adjacent the upper ends thereof. The support frame preferably includes three frame legs and it is preferably formed in a tripod-like configuration. Further, the support frame is constructed so that it is receivable on the base so that the frame legs thereof extend angularly upwardly from the base to the joining means. The legs of the support frame preferably have receiving sockets formed therein and the support frame assembly preferably includes a plurality of secondary gear elements having plugs thereon which are receivable in the sockets in the legs of the support frame for rotatably securing the secondary gear elements thereon. The support frame is preferably securable on the base so that one of the secondary gears on the support frame is in intermeshing engagement with the ring gear assembly for communicating rotation to the secondary gear on the support frame upon rotation of the gear ring. The support frame assembly preferably further includes a top gear which is rotatably mounted on the means joining the legs so that the top gear is received in intermeshing engagement with a secondary gear on one of the support frame legs. Accordingly, the gear assembly of the instant invention can be assembled so that the ring gear intermeshes with a secondary gear on one of the support frame legs for communicating rotation to another secondary gear on the same support frame leg which is in intermeshing engagement with the top gear for rotating the top gear. The support frame preferably still further includes a shaft extending through the means joining the legs, and the top gear is preferably mounted on one end of the shaft; and a further secondary gear is preferably mounted on the other end of the shaft so that it is positioned on the base between the support frame legs. Accordingly, rotation of the top gear causes the secondary gear on the shaft to be rotated so that another gear which is received in intermeshing engagement with the secondary gear on the shaft is also rotated.

Accordingly, it is seen that the toy gear assembly of the instant invention is adapted to be assembled in a variety of different ways for producing a variety of new and interesting gear train combinations. Specifically, the ring gear assembly is adapted to be rotated with a drive gear for effecting rotation of one or more gears on the base. The support frame assembly is adapted to be assembled with the top gear and one or more secondary gears in order to effect rotation of the top gear and a secondary gear mounted on the shaft. As a result, the gear assembly of the instant invention is adapted to be assembled so that one or more secondary gears received on the angular frame legs communicate rotation to the top gear, the shaft and secondary gear mounted on the shaft.

Accordingly, it is a primary object of the instant invention to provide an amusing and educational toy gear assembly.

Another object of the instant invention is to provide a toy gear assembly comprising a base and a ring gear assembly which is releasably securable on the base.

An even still further object of the instant invention is to provide a toy gear assembly comprising a base and a support frame assembly which is releasably secured on the base, wherein the support frame assembly includes a plurality of angularly disposed frame legs which are operative for rotatably mounting a plurality of secondary gears in angular relation to the base in order to communicate rotation between one or more gears on the base and a top gear on the support frame assembly.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
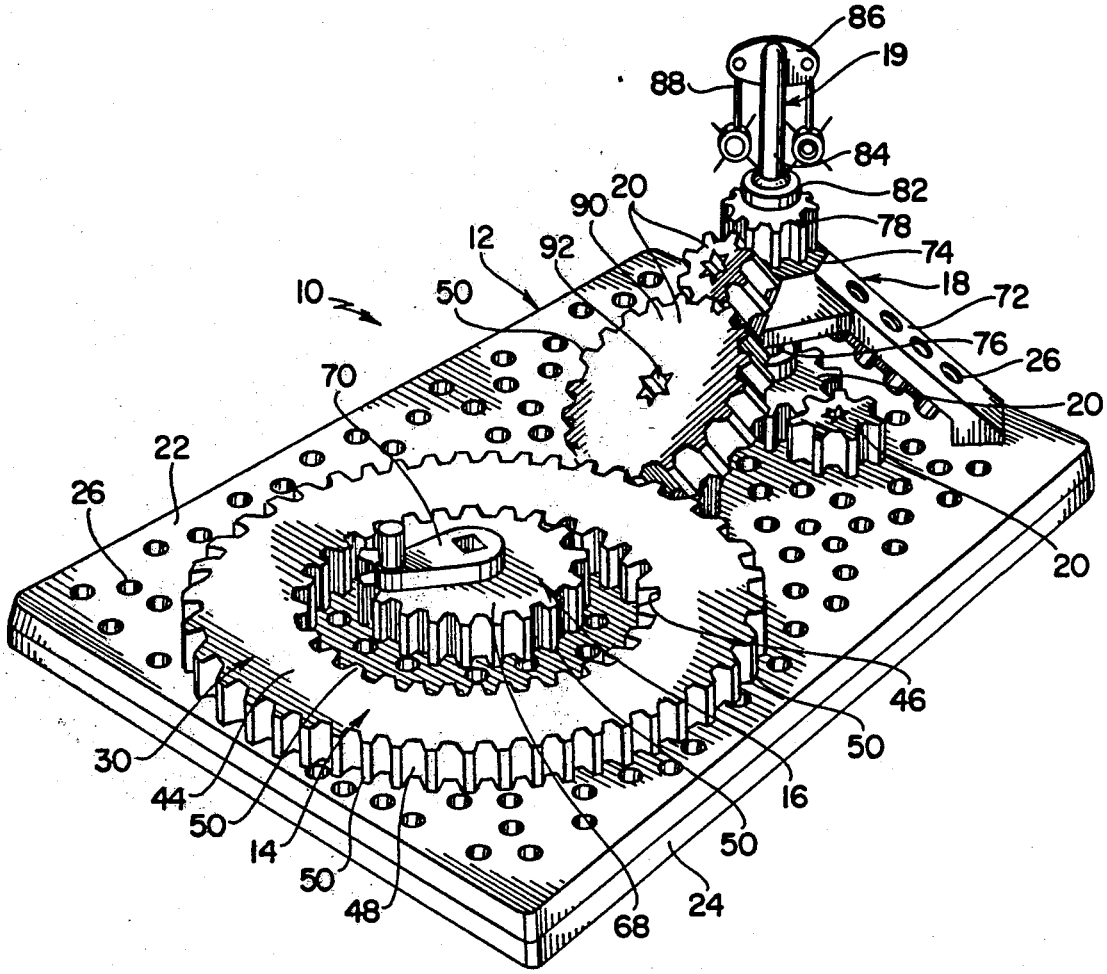
FIG. 1 is a perspective view of the toy gear assembly of the instant invention.
Figure 2:
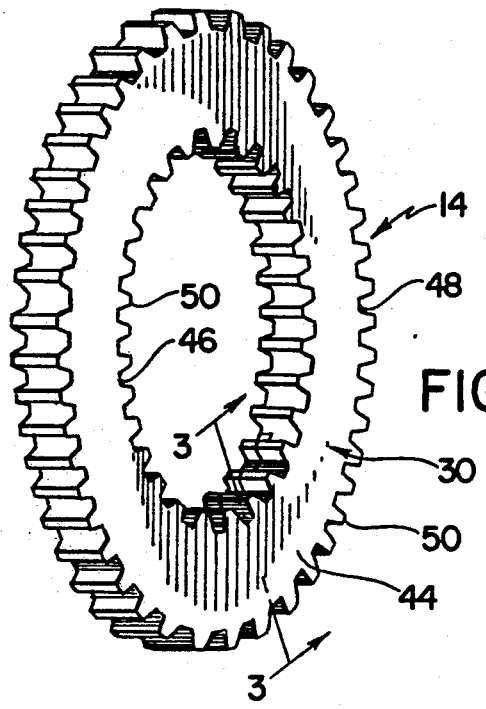
FIG. 2 is a perspective view of the ring gear assembly.
Figure 3:
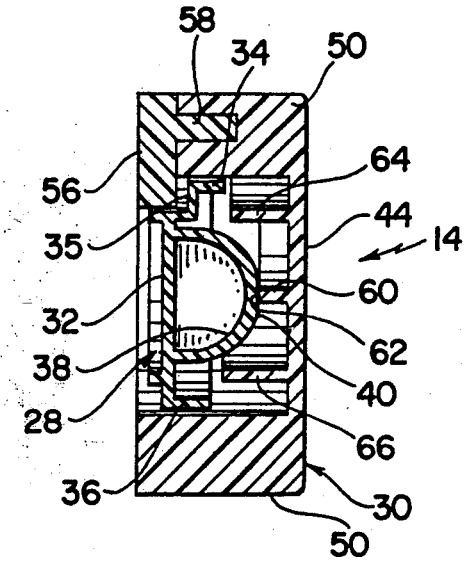
FIG. 3 is a sectional view taken along line 3—3 in FIG. 4.

Referring now to the drawings, the toy gear assembly of the instant invention is illustrated in FIGS. 1-6 and generally indicated at 10 in FIG. 1. The toy gear assembly 10 comprises a base generally indicated at 12, a ring gear assembly generally indicated at 14, a drive gear generally indicated at 16, a support frame assembly generally indicated at 18, an action element 19, and a plurality of secondary gears 20. The ring gear assembly 14, the drive gear 16, the support frame assembly 18 and the secondary gears 20 are adapted to be assembled on the base 12 so that rotation of the drive gear 16 causes rotation of ring gear 14 and the secondary gears 20 as will hereinafter be more fully set forth.

The base 12 is preferably molded from a suitable plastic material and it includes a top plate portion 22 and a peripheral side wall portion 24 which is operative for supporting the base 12 on a supporting surface. As illustrated, the base 12 further includes a plurality of upwardly opening receiving sockets 26 which are formed in the top plate portion 22. The receiving sockets 26 are of tubular configuration and they are positioned in closely spaced relation on the top plate portion 22 to enable the ring gear assembly 14, the drive gear 16, the support frame assembly 18 and the secondary gears 20 to be assembled at various different locations on the base 12.

Figure 5:
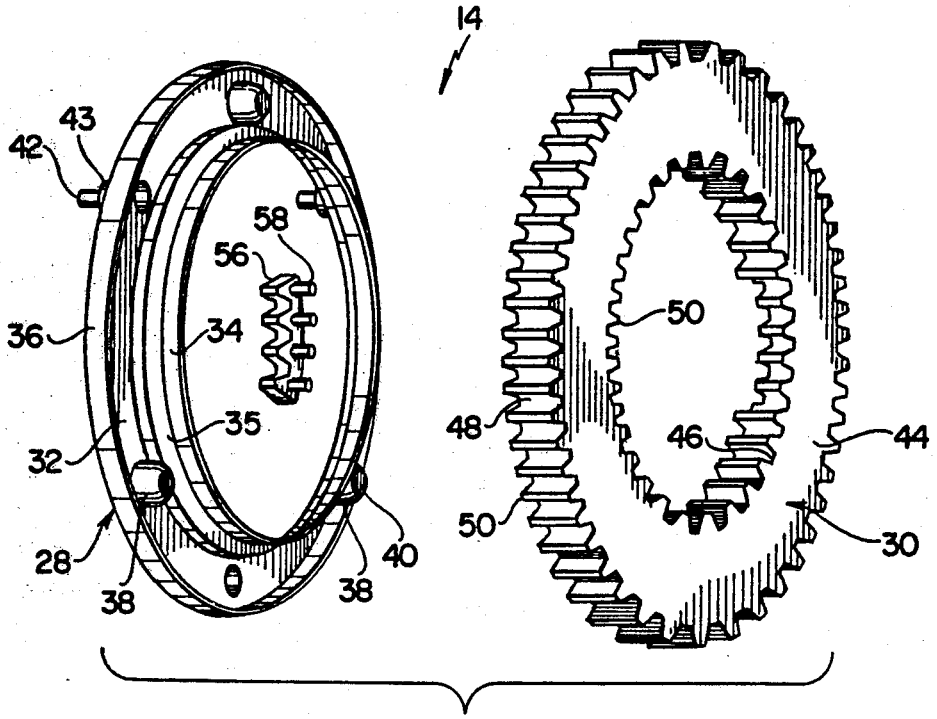
FIG. 5 is an exploded top perspective view of the ring gear assembly.
Figure 6:
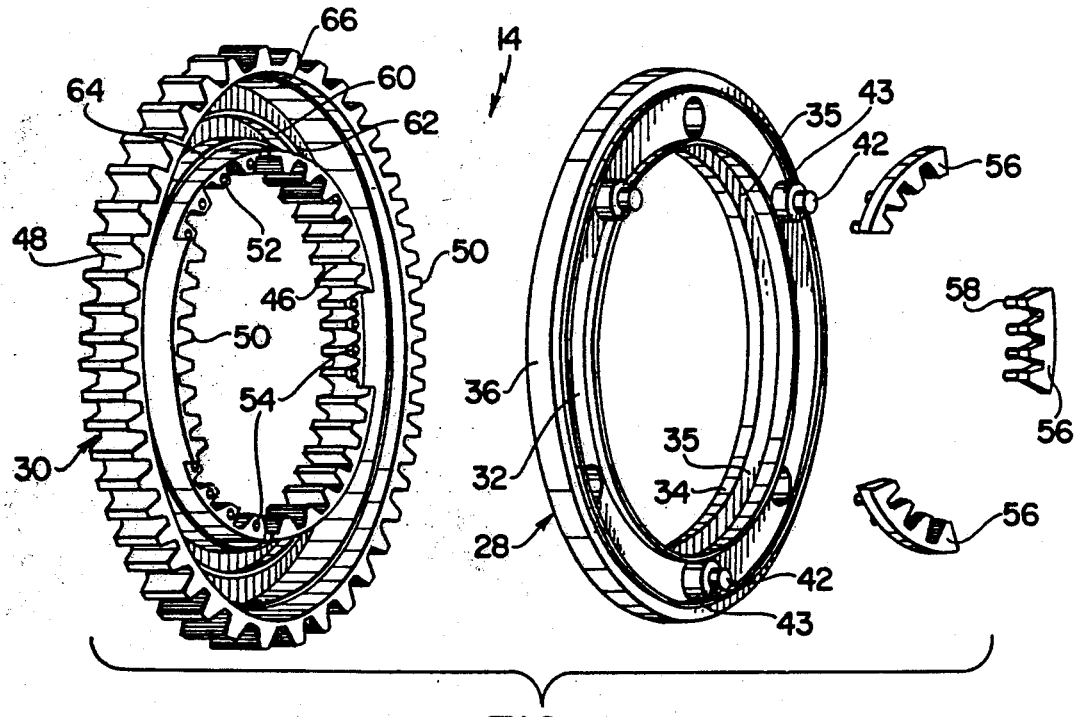
FIG. 6 is an exploded bottom perspective view thereof.

The ring gear assembly 14 is illustrated most clearly in FIGS. 5 and 6 and it comprises a mounting ring 28 and a gear ring 30. The mounting ring 28 includes a base wall 32 an inner retaining wall 34 which extends upwardly from an annular raised section 35 and an outer retaining wall 36. The mounting ring 28 further comprises a plurality of rounded bumps 38 which extend upwardly from the base wall 32 terminating in flattened ends 40. Also included in the mounting ring 28 is a plurality of plugs 42, having enlarged spacer hubs 43, which extend downwardly in substantially uniformly spaced relation from the base wall 32. The plugs 42 are dimensioned to be received in the sockets 26 for releasably securing the mounting ring 28 on the base 12. The gear ring 30 includes an upper or top wall 44 and inner and outer walls 46 and 48, respectively, which define inwardly and outwardly facing annular gear ring surfaces, respectively, on the gear ring 30. Formed on each of the inwardly and outwardly facing surfaces 46 and 48 is a plurality of gear teeth 50. However, as illustrated in FIG. 6, the inner wall 46 and the gear teeth 50 thereon are formed so as to include a plurality of lower open gap areas 54 and the adjacent teeth 50, which are of reduced height in the gap areas 52, have downwardly opening reduced bores 54 therein. The ring gear assembly 14 further includes a plurality of retaining gear segments 56 having pins 58 thereon. The retaining gear segments 56 are receivable in the gap segments 52 so that the pins 58 thereof are received and frictionally retained in the bores 54. The segments 56 are formed so that when they are received in the gap segments 52 in this manner, they cooperate with the gear teeth 50 on the inwardly facing wall 46 to form a substantially continuous gear face. Further, the segments 56 are formed so that they extend outwardly slightly beyond the wall 46 below the raised section 35 in order to retain the gear ring 30 on the mounting ring 28. The gear ring 30 further includes a centrally located substantially vertically disposed ridge or wall 60 which terminates in a lower edge 62 and inner and outer guide ridges or walls 64 and 66, respectively, which extend downwardly in inwardly and outwardly spaced relation, respectively, to the wall 60. The gear ring 30 is assembled on the support ring 28 so that the lower edge 62 of the wall 60 is received in engagement on the upper ends 40 of the bumps 38 for supporting the gear ring 30 on the support ring 28 so that the gear ring 30 is freely rotatable relative to the support ring 28 with a minimum of frictional resistance.

The drive gear 16 includes a substantially circular gear disc 68 having a plurality of peripheral gear teeth 50 thereon and a plug (not shown) which is substantially identical to the plugs 42 on the ring gear assembly 14 and which extends downwardly from the gear disc 68. The plug of the drive gear 16 is rotatably receivable in one of the sockets 26 in the base 12 in order to rotatably mount the drive gear 16 on the base 12. The drive gear 16 further comprises a removable handle element 70 which is manually manipulatable for rotating the drive gear 16 on the base 12. The drive gear 16 is dimensioned so that it is receivable in the interior of the ring gear assembly 14 in the manner illustrated in FIG. 1 so that the gear teeth 50 on the drive gear 16 are received in intermeshing engagement with the gear teeth 50 on the interior surface 46 of the gear ring 30 to enable the drive gear 16 to be effectively utilized for rotating the gear ring 30 of the ring gear assembly 14.

Figure 4:
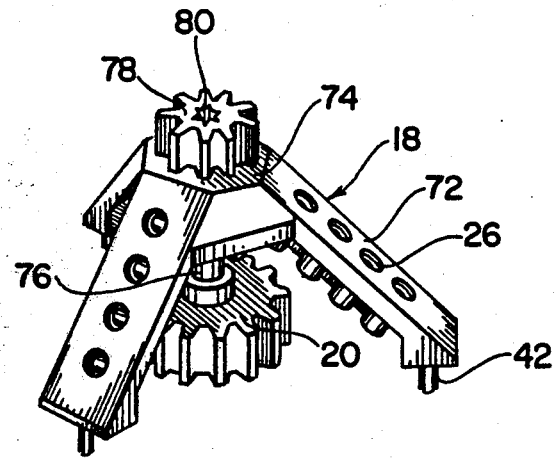
FIG. 4 is a perspective view of the support frame assembly.

The support frame assembly 18 is illustrated in FIGS. 1 and 4 and it comprises a tripod-like structure including three legs 72 which are integrally connected with an upper connecting member 74. The legs 72 are disposed in substantially equally angularly spaced relation so that they cooperate to define a tripod-like structure, and the connecting member 74 is operative for connecting the legs 72 adjacent the upper ends thereof. Each of the legs 72 has a plug 42 formed on the lower end thereof for mounting the support frame assembly 18 on the base 12 and each of the legs 72 has a plurality of sockets 26 formed therein which are substantially identical to the sockets 26 on the base 12. The legs 72 are assembled with the connecting member 74 so that when the support frame assembly 18 is assembled on the base 12 the legs 72 extend angularly upwardly from the base 12 to the connecting member 74. The support frame assembly 18 further comprises a shaft 76 which is rotatably mounted in the connecting member 14 so that it extends substantially vertically downwardly therethrough and a top gear 78 having an upwardly opening socket 80 formed therein is assembled on the shaft 76 above the connecting member 74. A secondary gear 20 is assembled on the shaft 76 beneath the connecting member 74 so that the secondary gear 20 on the shaft 76 is positioned on the upper surface of the top plate portion 22 of the base 12 when the support frame assembly 18 is received on the base 12. As illustrated in FIG. 1, when the support frame assembly 18 is received on the base 12 one or more of the secondary gears 20 can also be assembled on the legs 72 in order to communicate rotational motion between one or more gears on the base 12 and the top gear 78. Further, as illustrated, when rotational motion is communicated to the top gear 78, the shaft 76 and the secondary gear 20 thereon are also rotated.

The action element 19 includes a base portion 82 having a stem (not shown) which is releasably receivable in the socket 80 in the top gear 78 for mounting the action element 19 on the top gear 78. The action element 19 further includes a shaft portion 84 which extends upwardly from the stem thereof, an upper cross piece 86 and a pair of pivot members 88 on the cross member 86. The pivot members 88 are pivotally attached to the cross member 86 so that they are pivotable outwardly by the centrifugal force which is generated therein when the action element 19 is rotated with the top gear 78.

The secondary gears 20 are of conventional construction and each includes a gear disc portion 90 having a plurality of gear teeth 50 thereon, an axial plug 42 which is receivable in one of the sockets 26 and a socket 92 which is configured for receiving the action element 19 or some other type of similar action element (not shown).

For use and operation of the toy gear assembly 10 the ring gear assembly 14, the drive gear 16 and the support frame assembly 18 are assembled on the base 12 in the manner illustrated in FIG. 1. A plurality of secondary gears 20 can then assembled on the support frame assembly 18 and on the base 12, and the action element 19 can be assembled on the base 12 or on the support frame assembly 18. The drive gear 16 can then manually operated to rotate the ring gear assembly 14, the secondary gears 20, the top gear 78, and the action element 19.

It is seen therefore that the instant invention provides an effective toy gear assembly. The ring gear assembly 14 and the support frame 18 are adapted to enable a user to assemble various gears, including the secondary gears 20, in various new combinations to produce amusing and educational gear train assemblies. Accordingly, it is seen that the toy gear assembly of the instant invention represents a significant advancement in the toy art which has both commercial and educational merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A toy gear assembly comprising a base adapted to be received on supporting surface and having a plurality of upwardly opening receiving sockets therein, and a ring gear assembly releasably receivable on said base, said ring gear assembly including a mounting ring having a plurality of downwardly extending plugs thereon which are releasably receivable in a portion of said sockets for releasably securing said mounting ring on said base and a gear ring of ring-like configuration received and secured in coaxial relation on said mounting ring so that said gear ring is axially rotatable relative to said mounting ring, said gear ring having inwardly and outwardly facing annular gear ring surfaces thereon, at least one of said annular gear ring surfaces having a plurality of gear teeth thereon.

2. In the toy gear assembly of claim 1, said inwardly and outwardly facing annular gear ring surfaces each having a plurality of gear teeth thereon.

3. The toy gear assembly of claim 1 further comprising a drive gear including a substantially circular drive gear disc having a plurality of peripheral gear teeth thereon and a downwardly extending axial plug on said drive gear disc, said drive gear being receivable on said base so that the plug on said drive gear disc is received in one of said receiving sockets and so that the gear teeth on said drive gear disc are received in intermeshing engagement with the gear teeth on said ring gear assembly.

4. In the toy gear assembly of claim 3, said drive gear further including handle means for manually rotating said drive gear to effect rotation of said gear ring.

5. In the toy gear assembly of claim 4, said gear ring having gear teeth on the inwardly facing annular gear ring surfaces thereof, said drive gear being receivable in the interior of said ring gear assembly so that the gear teeth on said drive gear are received in intermeshing engagement with the gear teeth on the inwardly facing annular gear ring surface of said gear ring.

6. A toy gear assembly comprising a base adapted to be received on a supporting surface, a ring gear assembly including a mounting ring and a gear ring of ring-like configuration received and secured in coaxial relation on said mounting ring so that said gear ring is axially rotatable relative to said mounting ring, said gear ring having inwardly and outwardly facing annular gear ring surfaces thereon, at least one of said annular gear ring surfaces having a plurality of gear teeth thereon, and means for releasably mounting said mounting ring on said base.

7. In the toy gear assembly of claim 6, one of either said mounting ring or said gear ring having a plurality of bumps thereon, the other one of either said mounting ring or said gear ring having a ring-like support ridge thereon, said support ridge terminating in an edge, said bumps terminating in ends, said bumps and said support ridge being in substantially aligned engagement so that said edge is in engagement with the ends of said bumps and so that said bumps and said support ridge cooperate to support said gear ring on said mounting ring.

8. In the toy gear assembly of claim 7, said ridge comprising a substantially vertical ring-like wall.

9. The toy gear assembly of claim 6, further comprising a tripod-like support frame assembly including three substantially uniformly angularly spaced frame legs, said frame legs having upper and lower ends, and means joining said frame legs in angular relation adjacent the upper ends thereof, means for releasably securing said support frame on said base so that said frame legs extend angularly upwardly from said base to said means joining said frame legs, at least one secondary gear element including a secondary gear disc having a plurality of gear teeth thereon and means releasably mounting said secondary gear element on one of said frame legs, said support frame with said secondary gear thereon being releasably securable on said base so that said secondary gear is in intermeshing engagement with said ring gear assembly when said ring gear assembly is received on said base for communicating rotation to said secondary gear upon rotation of said gear ring.

10. The toy gear assembly of claim 6 further comprising a tripod-like support frame assembly including three substantially uniformly angularly spaced frame legs, said frame legs having upper and lower ends, and means joining said frame legs in angular relation adjacent the upper ends thereof, means for releasably securing said support frame on said base so that said frame legs extend angularly upwardly from said base to said means joining said frame legs, at least one secondary gear element including a secondary gear disc having a plurality of gear teeth thereon and means releasably mounting said secondary gear element on one of said frame legs, and a top gear rotatably mounted on said means joining said frame legs, said secondary gear being releasably receivable on one cf said frame legs so that said secondary gear is received in intermeshing engagement with said top gear.

11. The toy gear assembly of claim 6 further comprising a tripod-like support frame assembly including three substantially uniformly angularly spaced frame legs having upper and lower ends, and means joining said frame legs in angular relation adjacent the upper ends thereof, means for releasably securing said support frame on said base so that said frame legs extend angularly upwardly from said base to said means joining said frame legs, a rotatable shaft extending substantially vertically through said means joining said frame legs, a top gear mounted on said shaft above said means joining said frame legs and a secondary gear mounted on said shaft below said means joining said frame legs, said secondary gear being positioned on said base between said frame legs when said support frame is received on said base.

12. In the toy gear assembly of claim 6, said inwardly and outwardly facing annular gear ring surfaces each having a plurality of gear teeth thereon.

13. The toy gear assembly of claim 6 further comprising a drive gear including a substantially circular drive gear disc having a plurality of peripheral gear teeth thereon and means releasably rotatably mounting said drive gear on said base so that the gear teeth on said drive gear are received in intermeshing engagement with the gear teeth on said ring gear assembly.

14. In the toy gear assembly of claim 13, said gear ring having gear teeth on the inwardly facing annular gear ring surface thereon, said drive gear being received in the interior of said ring gear assembly so that the gear teeth on said drive gear are received in intermeshing engagement with the gear teeth on the inwardly facing annular gear ring surface of said gear ring.

* * * * *